US008850945B2

(12) United States Patent
Tatum

(10) Patent No.: US 8,850,945 B2
(45) Date of Patent: Oct. 7, 2014

(54) RAPID-LOAD APPLIANCE FOR USE WITH BELT-FED MACHINE GUNS

(71) Applicant: John Tatum, Temple, TX (US)

(72) Inventor: John Tatum, Temple, TX (US)

( * ) Notice: Subject to any disclaimer, the term of this patent is extended or adjusted under 35 U.S.C. 154(b) by 0 days.

(21) Appl. No.: 13/720,932

(22) Filed: Dec. 19, 2012

(65) Prior Publication Data

US 2013/0098231 A1 Apr. 25, 2013

Related U.S. Application Data

(60) Provisional application No. 61/578,923, filed on Dec. 22, 2011.

(51) Int. Cl.
*F41A 9/34* (2006.01)
*F41A 9/79* (2006.01)

(52) U.S. Cl.
CPC .... *F41A 9/34* (2013.01); *F41A 9/79* (2013.01)
USPC ..... 89/34; 89/33.14

(58) Field of Classification Search
CPC ..... F41A 9/79; F41A 9/80; F41A 9/86; F41A 9/34; F41A 9/87
USPC ..... 89/37.21, 37.22, 34, 33.14, 33.16
See application file for complete search history.

(56) References Cited

U.S. PATENT DOCUMENTS

| | | | | |
|---|---|---|---|---|
| 2,386,894 | A * | 10/1945 | Hartley | 89/33.16 |
| 3,246,565 | A * | 4/1966 | Ramseyer | 89/33.14 |
| 6,393,960 | B1 * | 5/2002 | Bilger | 89/37.03 |
| 6,439,098 | B1 * | 8/2002 | Dillon | 89/34 |
| 7,546,794 | B1 * | 6/2009 | Sarles et al. | 89/34 |
| 2012/0318128 | A1 * | 12/2012 | Gotie | 89/33.14 |

* cited by examiner

*Primary Examiner* — Stephen M Johnson
(74) *Attorney, Agent, or Firm* — William Lovin & Assoc., LLC

(57) ABSTRACT

The invention relates to a device for positioning multiple, filled ammunition canisters near the receiver of a machine gun such that when the ammunition belt in the first canister is exhausted, the gunner merely removes the first canister from the device and a new, full canister containing a new ammunition belt slides into place by means of gravity. The present invention enables the gunner to more rapidly reload the machine gun, thus improving firing rate and gunner safety.

11 Claims, 5 Drawing Sheets

RAPID-LOAD APPLIANCE FOR USE WITH BELT-FED MACHINE GUNS

CROSS-REFERENCE TO RELATED APPLICATIONS

This application takes benefit of U.S. Prov. App. 61/578,923, as filed on Dec. 22, 2011, which is incorporated in its entirety by reference.

FIELD OF THE INVENTION

The present disclosure relates to a device and method for positioning multiple, filled ammunition canisters near the receiver of a machine gun to enable the gunner to more rapidly reload the machine gun, thus improving firing rate and gunner safety.

BACKGROUND OF THE INVENTION

Machine guns such as the M2A1 ("Ma Deuce").50 caliber machine gun and the M240 .30 caliber machine gun utilize belt-fed ammunition to rapidly and automatically cycle a new round into the receiver of the weapon after a previous round has been fired. Grenade launchers like the Mk 19 also utilize belt-fed ammunition. For convenience, these belts are stored and transported in ammunition canisters, typically steel boxes with removable, gasket sealed lids. In some applications, these belts are completely removed from the canisters they are stored in and simply fed into the gun manually. In other applications, the gun is mounted on a vehicle or other conveyance by means of a cradle with a bracket that supports a full ammunition canister lateral to the feed side of the gun. In these applications, the gunner first positions a full canister in the bracket and places a pin through the bracket and canister to secure the canister to the bracket. The first part of the ammunition belt is then placed in the receiver, whereupon the gunner closes the receiver, charges the weapon, and commences firing. When the belt is exhausted, the gunner unpins and removes the empty canister from the bracket, places the empty canister to the side, retrieves a new, full canister, positions the new canister in the bracket and secures it with the pin, places the first part of the new belt in the receiver, charges the weapon, and the cycle repeats. Clearly, the process of changing an empty canister for a full one is a time consuming task. This is dangerous when the gunner, engaged in a potentially lethal firefight, has to pause firing to complete the tasks articulated above.

It is an object of the present invention to provide an appliance and a method of use that allows a gunner to more rapidly reload a belt-fed weapon.

SUMMARY OF THE INVENTION

The appliance is in the general form of an open-top rectangular prism. The interior container element of the appliance is designed to securely hold two standard ammunition canisters arranged end to end. The appliance is constructed of mild steel or some other suitably strong substance with potions of the lateral sides, ends, and bottom removed to decrease the weight of the appliance. Attached to one end of the appliance is a mounting assembly. The mounting assembly is in the form of a right triangular prism, equal in depth to the container element's width. The mounting assembly is rigidly connected to the container element along that surface of the mounting assembly defined by the hypotenuse of the mounting assembly such that the line described by the most acute angle of the mounting assembly is collinearly adjoined with the upper edge of one end wall of the container element. In this configuration, the long side of the triangular prism opposite the side defined by the hypotenuse faces out and is angled up and away from the vertical end wall of the appliance. Attached to this outward-facing, angled face of the mounting assembly are two mounting studs and a mounting bolt. Ordinarily, the appliance is mounted to a gun cradle by slipping the two mounting studs into matching keyed slots in the cradle. Simultaneously, the mounting bolt protrudes through a slot in the cradle. After the appliance has been mounted to the gun cradle, a knurled mounting nut is screwed onto the mounting bolt to secure the appliance to the gun cradle.

Aligned along the inside bottom of the appliance are two longitudinally disposed nylon strips. Also, at the midpoint of the container element on the side facing the gunner, is a releasable lock means such as a spring actuated release peg, operable from the outside of the container element. Ordinarily, this spring actuated release peg protrudes through the side of the container element and extends into the inside cavity of the container element. The peg is used to separate an outboard ammunition canister (one mounted away from the breach of the machine gun) from an inboard one (one mounted adjacent to the breach of the machine gun), thus making it easier to remove the inboard canister when it is empty. In a first embodiment of the present invention, the rectangular top opening is flared outward to facilitate the quick insertion of filled ammunition canisters from the top of the appliance. In a second embodiment of the present invention, the rectangular top opening is un-flared and partially covered by a first hinged access door while the end opposite the mounting assembly is equipped with a second hinged access door. The first hinged access door is provided to prevent shorter (and thus lighter) ammunition belts from being displaced out of their respective ammunition canisters when traversing rough terrain while still allowing the user to insert and remove ammunition canisters from the top of the appliance. The second hinged access door allows the user to insert ammunition canisters from the end of the appliance.

DETAILED DESCRIPTION OF THE PREFERRED EMBODIMENTS

Figure 1:
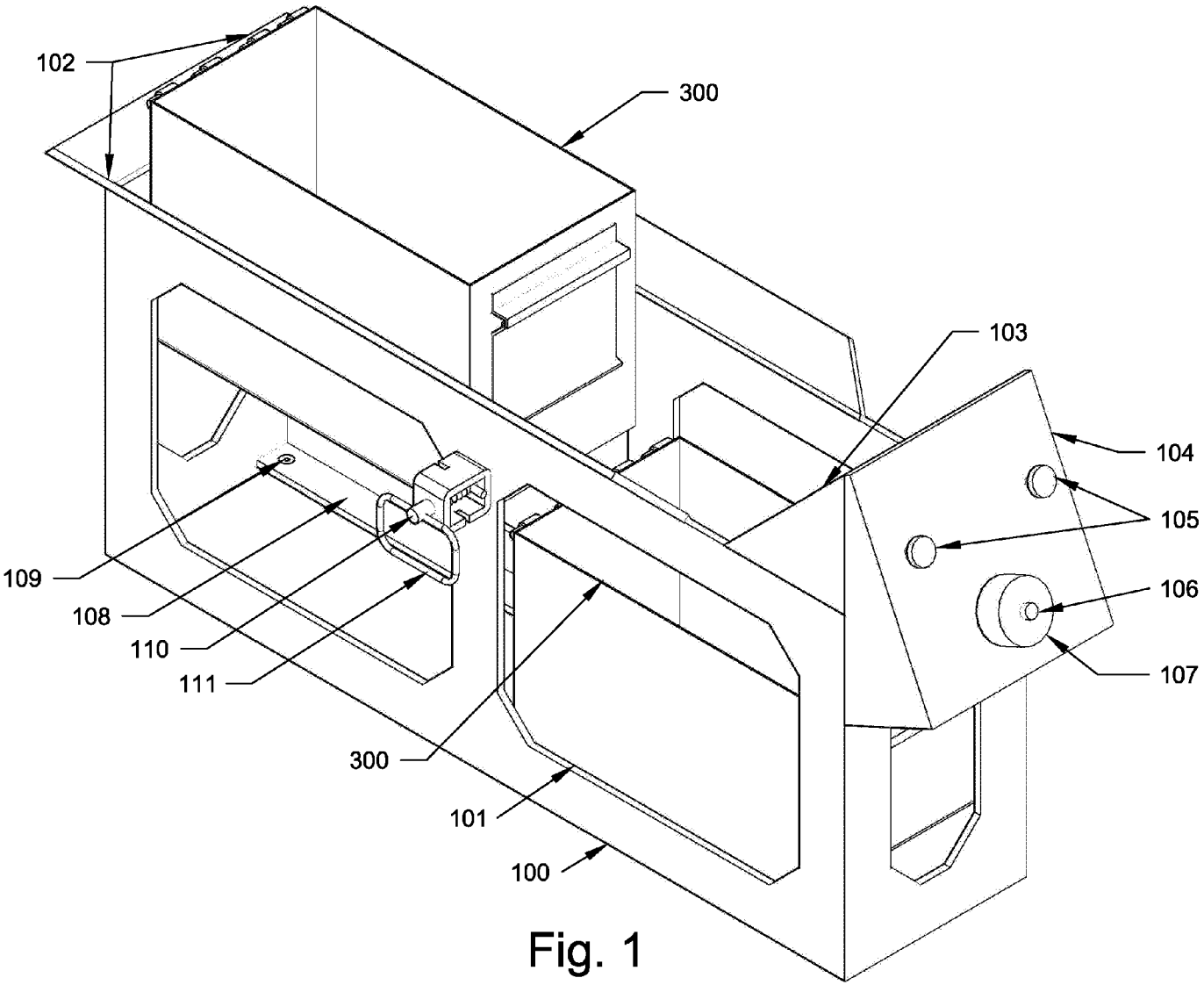
FIG. 1 is an oblique view of a rapid-load appliance according to a first embodiment of the present invention from the mounting assembly end.
Figure 2:
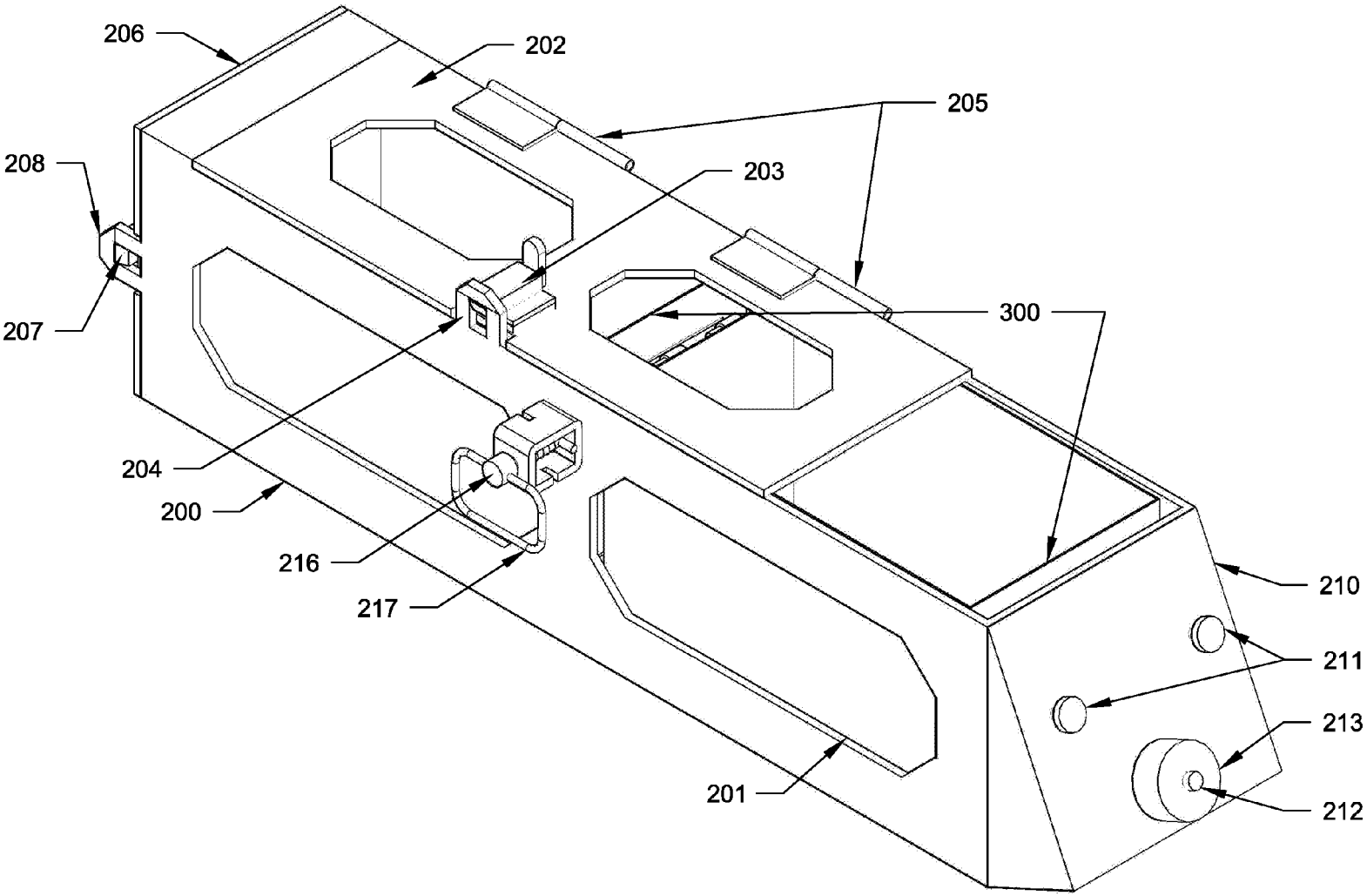
FIG. 2 is an oblique view of a rapid-load appliance according to a second embodiment of the present invention from the mounting assembly end.
Figure 3:
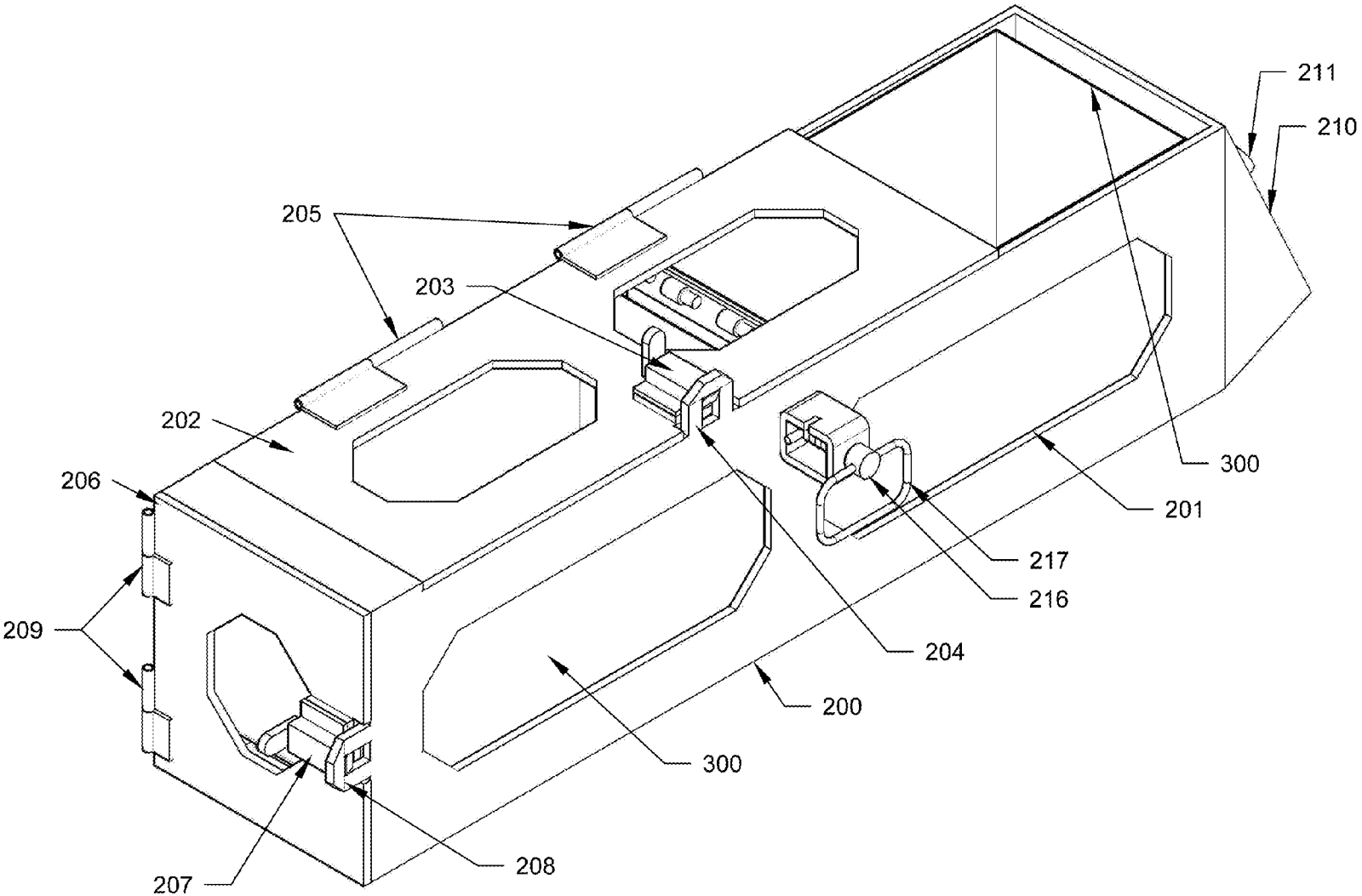
FIG. 3 is an oblique view of a rapid-load appliance according to a second embodiment of the present invention from the end opposite the mounting assembly.
Figure 4:
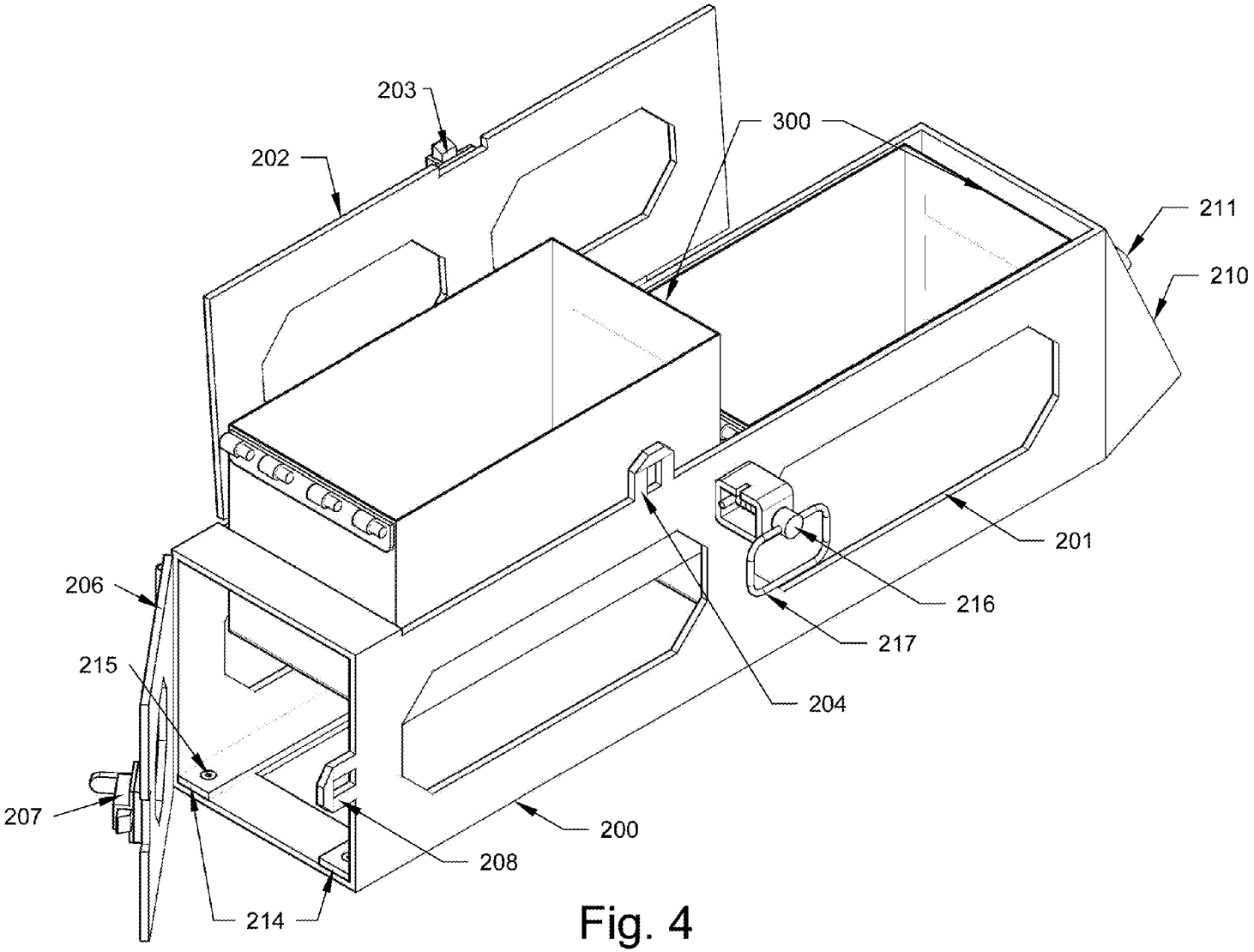
FIG. 4 is an oblique view of a rapid-load appliance according to a second embodiment of the present invention from the end opposite the mounting assembly and showing the internal details of the appliance.
Figure 5:
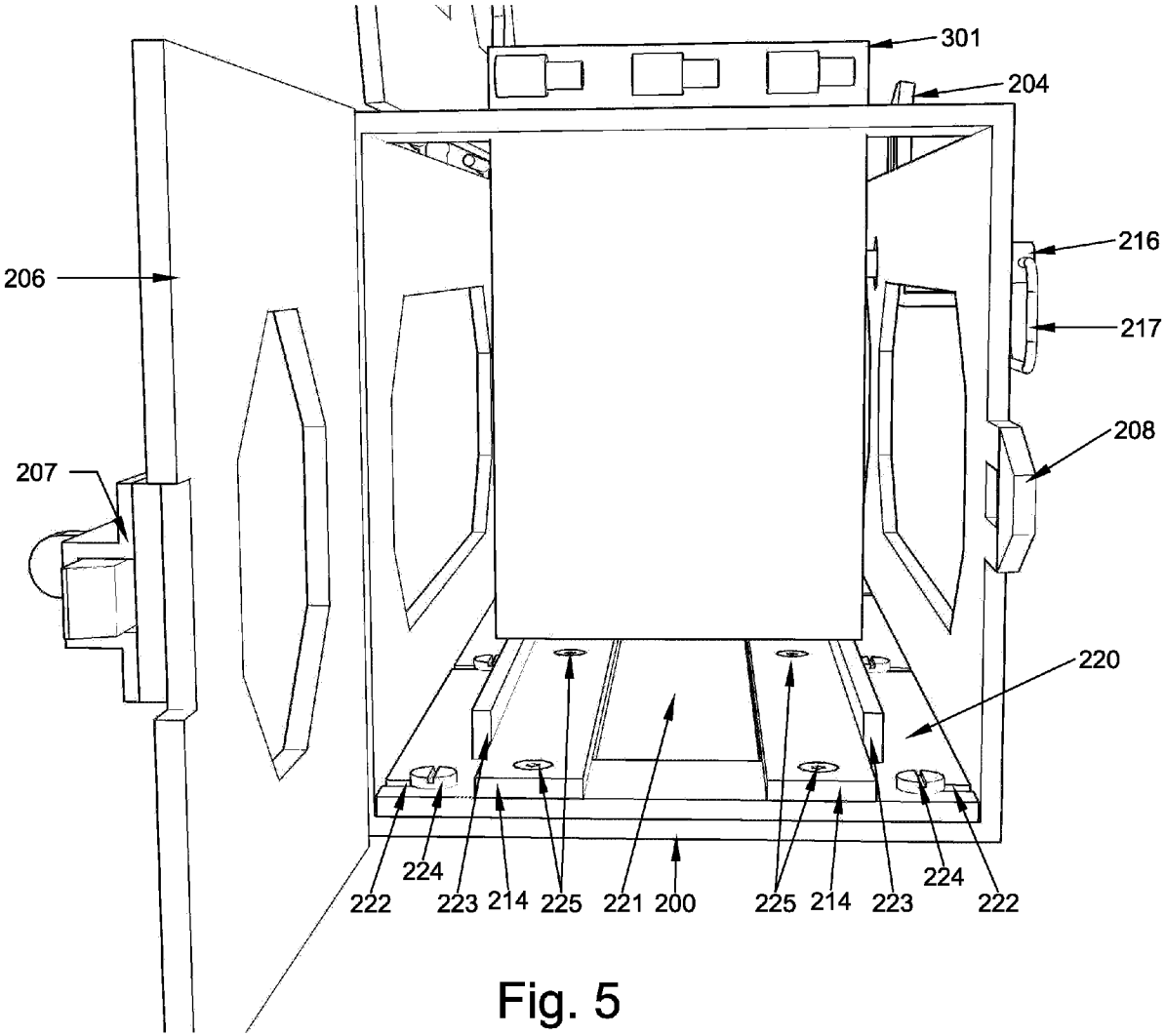
FIG. 5 is a view inside of a rapid-load appliance according to a second embodiment of the present invention from the end opposite the mounting assembly and showing the internal details of the appliance. Also shown is an adaptor plate used to adapt the appliance for use with narrower ammunition canisters.

Referring now to FIG. 1, the first embodiment of the device is typically used with either an M2A1 .50 caliber machine gun or a Mk 19 automatic grenade launcher mounted on a Mk 64, Mk 93, or equivalent gun cradle. This embodiment of the device is dimensioned to accept standard M548 ammunition canisters 300 holding 200-round and 48-round belts, respectively, of .50 caliber machine gun ammunition or 40 mm grenades. In this embodiment, container element 100 is in the form of an open-top rectangular prism. The interior portion of container element 100 is dimensioned to hold two M548 ammunition canisters 300 arranged end to end. Container element 100 is constructed of mild steel or other suitable substance with portions of the lateral sides, ends, and bottom 101 (typical) removed to decrease the weight of the device.

The top opening of container element 100 is outwardly flared 102 to allow for the quick insertion of filled ammunition canisters 300. One end wall of container element 100 is taller than the other end wall and is un-flared. This taller end is connected to the upper portions of the adjacent lower sides of container element 100 by triangular strengthening gussets 103.

Attached to the taller end of container element 100 at its un-flared top edge, is mounting assembly 104. Mounting assembly 104 is in the form of a right triangular prism, equal in depth to the width of container element 100. Mounting assembly 104 is rigidly connected to container element 100 along that surface of mounting assembly 104 defined by the hypotenuse of mounting assembly 104 such that the line described by the most acute angle of mounting assembly 104 is collinearly adjoined with the upper edge of the taller, un-flared end of container element 100. In this configuration, the longest side of mounting assembly 104 opposite the side formed by the hypotenuse of mounting assembly 104 faces out and is angled up and away from the taller vertical end wall of container element 100. Attached to the outward-facing, angled face of mounting assembly 104 are two mounting studs 105 and a mounting bolt 106. The outward-facing, angled face of mounting assembly 104 is disposed at an angle greater than about 15° and less than about 35°—preferably about 25°—from the plane of the taller end wall of container element 100.

Aligned along the inside bottom of container element 100 are at least two longitudinally disposed nylon or Teflon® wear strips 108 aligned lengthwise along the longer dimension of container element 100. Nylon or Teflon wear strips 108 are drilled and countersunk such that they may be affixed to containing element 100 by means of a multiplicity of flathead screws 109. At the midpoint of container element 100 on the side facing the gunner is a releasable lock means such as spring actuated release peg 110. Spring actuated release peg 110 is equipped with handle 111 operable from the outside of container element 100. Release peg 110 protrudes through the side of container element 100 and extends into the inside cavity of container element 100. Release peg 110 is used to physically separate a full ammunition canister 300 at the outboard position from an empty ammunition canister 300 at the inboard position thus making it easier to remove inboard canister 300. After removing an empty ammunition canister 300 at the inboard position, the user actuates handle 111 thus retracting release peg 110 inside container element 100. This allows a full ammunition canister 300 at the outboard position to slide by means of gravity to the inboard position of containing element 100.

The first embodiment of the present invention is used in the following manner: First, the gunner inserts the two mounting studs 105 on the outward-facing, angled face of mounting assembly 104 into two matching keyed mounting slots on the mating surface of a Mk 64, Mk 93, or equivalent gun cradle. Simultaneously, mounting bolt 106 is allowed to protrude through a mating slot in the gun cradle. Next, after the device has been mounted to the gun cradle, a knurled mounting nut 107 is screwed onto mounting bolt 106 to secure the device to the gun cradle. When installed this way, the device is aligned at an angle with respect to horizontal such that the distal, unattached end of the device is higher than the proximal, attached end of the device. Ordinarily, the angle formed by the plane of the bottom surface of the device with respect to horizontal is at least about 15° and less than about 35° preferably about 25°. The gunner places two filled M548 ammunition canisters 300 in the device, end-to-end, such that release peg 110 protrudes into the inside cavity of container element 100 and is insinuated between the distal end of inboard canister 300 and the proximal end of outboard canister 300. The gunner then loads the ammunition belt from inboard ammunition canister 300 into the weapon and operates the weapon normally. When the first belt is exhausted and inboard canister 300 is empty, the gunner removes inboard canister 300, actuates handle 111 retracting release peg 110 inside container element 100 such that the full ammunition canister 300 at the outboard position is freed to slide by means of gravity down nylon strips 108 such that it occupies the inboard position of containing element 100 adjacent to the weapon. The gunner loads the belt and operates the weapon normally. By this process, the gunner is rapidly able to reload the weapon with a new belt from a second full canister 300. This decreases the time to reload the weapon while improving firing rate and gunner safety.

Referring now to FIGS. 2, 3, 4, and 5 the second embodiment of the device is typically used with either an M2A1 .50 caliber machine gun or a M240 7.62 mm machine gun mounted in a Mk 64, Mk 93, or equivalent gun cradle. This embodiment of the device is dimensioned to accept standard M2A1 .50 caliber ammunition canisters 300 holding 100-round round belts of .50 caliber machine gun ammunition. In this embodiment, container element 200 is in the form of a rectangular prism. The interior portion of container element 200 is dimensioned to hold two M2A1 .50 caliber ammunition canisters 300 arranged end to end. Container element 200 is constructed of mild steel or other suitable substance with portions of the lateral sides, ends, and bottom 201 (typical) removed to decrease the weight of the device. An adapter plate 220 is provided that allows the user to configure the device to accept narrower M19/M19A1 7.62 mm ammunition canisters 301 holding 200-round belts of 7.62 mm machine gun ammunition.

The top opening of container element 200 is covered by hinged top access door 202. Hinged top access door 202 is held in the closed position by means of a first latching means such as top spring loaded catch 203. The pawl of top spring loaded catch 203 interoperates with top catch plate 204 to secure hinged top access door 202 in the closed position. Top hinges 205 are slidably separable allowing thus allowing the user to remove hinged top access door 202 from container element 200 completely. One end opening of container element 200 is covered by hinged end access door 206. Hinged end access door 206 is held in the closed position by means of a second latching means such as end spring loaded catch 207. The pawl of end spring loaded catch 207 interoperates with end catch plate 208 to secure hinged end access door 206 in the closed position. End hinges 209 are slidably separable allowing thus allowing the user to remove hinged end access door 206 from container element 200 completely.

Attached to end of container element 200 at the end opposite hinged end access door 206, is mounting assembly 210. Mounting assembly 210 is in the form of a right triangular prism, equal in depth to the width of container element 200.

Mounting assembly 210 is rigidly connected to container element 200 along that surface of mounting assembly 210 defined by the hypotenuse of mounting assembly 210 such that the line described by the most acute angle of mounting assembly 210 is collinearly adjoined with the upper edge of container element 200. In this configuration, the longest side of mounting assembly 210 opposite the side defined by the hypotenuse of mounting assembly 210 faces out and is angled up and away from the end wall of container element 200. Attached to the outward-facing, angled face of mounting assembly 210 are two mounting studs 211 and a mounting bolt 212. The outward-facing, angled face of mounting assembly 210 is disposed at an angle greater than about 15° and less than about 35°—preferably about 25°—from the plane of end wall of container element 200.

Aligned along the inside bottom of container element 200 are at least two longitudinally disposed nylon or Teflon wear strips 214 aligned lengthwise along with the longer dimension of container element 200. Nylon or Teflon wear strips 214 are drilled and countersunk such that they may be affixed to containing element 200 by means of a multiplicity of flathead screws 215. At the midpoint of container element 200 on the side facing the gunner is a releasable lock means such as spring actuated release peg 216. Spring actuated release peg 216 is equipped with handle 217 operable from the outside of container element 200. Release peg 216 protrudes through the side of container element 200 and extends into the inside cavity of container element 200. Release peg 216 is used to physically separate a full ammunition canister 300 or 301 at the outboard position from an empty ammunition canister 300 or 301 at the inboard position thus making it easier to remove inboard canister 300 or 301. After removing an empty ammunition canister 300 or 301 at the inboard position, the user actuates handle 217 thus retracting release peg 216 inside container element 200. This allows a full ammunition canister 300 or 301 at the outboard position to slide by means of gravity to the inboard position of containing element 200.

Adapter plate 220 is provided to allow the user to configure the device to accept narrower M19/M19A1 7.62 mm ammunition canisters 301 holding 200-round belts of 7.62 mm machine gun ammunition. Adapter plate 220 is constructed of mild steel or some other suitably strong substance with portions 221 removed to decrease weight. Adapter plate 220 features a multiplicity of mounting slots or holes 222 (typical). Adapter plate 220 also features two perpendicularly disposed parallel guide walls 223 positioned far enough apart that a conventional M19/M19A1 7.62 mm ammunition canister 301 slides smoothly between them. To install adapter plate 220, the user first removes flathead screws 215 and nylon or Teflon wear strips 214. The user places adapter plate 220 into container element 200 such that the multiplicity of mounting slots or holes 222 are coaxially aligned with the multiplicity of threaded holes from which flathead screws 215 were removed. The user secures adapter plate 220 to containing element 200 by means of a multiplicity of adapter plate mounting screws 224 (typical). Finally the user places nylon or Teflon wear strips 214 just inboard of parallel guide walls 223 and secures nylon or Teflon wear strips 214 to adapter plate 220 by means of additional flathead screws 225 (typical). In lieu of additional flathead screws 225, it will be apparent that adapter plate 220 may be tapped such that flathead screws 215 may be reused to attach nylon or Teflon wear strips 214 just inboard of parallel guide walls 223.

The second embodiment of the device is used in the following manner: First, the gunner inserts the two mounting studs 211 on the outward-facing, angled face of mounting assembly 210 into two matching keyed mounting slots on the mating surface of a Mk 64, Mk 93, or equivalent gun cradle. Simultaneously, mounting bolt 212 is allowed to protrude through a mating slot in the gun cradle. Next, after the device has been mounted to the gun cradle, knurled mounting nut 213 is screwed onto mounting bolt 212 to secure the device to the gun cradle. When installed this way, the device is aligned at an angle with respect to horizontal such that the distal, unattached end of the device is higher than the proximal, attached end of the device. Ordinarily, the angle formed by the plane of the bottom surface of the device with respect to horizontal is at least about 15° and less than about 35° preferably about 25°. The device may be loaded in two ways: First the gunner actuates top spring loaded catch 203 to swing hinged top access door 202 up and open. The gunner then places two filled ammunition canisters 300 or 301 in the device, end-to-end, such that spring actuated release peg 216 protrudes into the inside cavity of container element 200 and is insinuated between the distal end of the inboard canister 300 or 301 and the proximal end of the outboard canister 300 or 301. After closing hinged top access door 202, the gunner then loads the ammunition belt from inboard ammunition canister 300 or 301 into the weapon and operates the weapon normally. When the first belt is exhausted and inboard canister 300 or 301 is empty, the gunner actuates top spring loaded catch 203 to swing hinged top access door 202 up and open and removes the inboard ammunition canister 300 or 301. After closing hinged top access door 202, the gunner actuates handle 217 retracting spring actuated release peg 216 inside container element 200 such that the full ammunition canister 300 or 301 at the outboard position is freed to slide by means of gravity down nylon or Teflon wear strips 214 such that it occupies the inboard position of containing element 200 adjacent to the weapon. The gunner loads the belt and operates the weapon normally. Alternately, an assistant gunner positioned lower in the vehicle and shielded from enemy fire, actuates end spring loaded catch 207 to swing hinged end access door 206 away and open. The assistant gunner actuates handle 217 retracting spring actuated release peg 216 inside containing element 200 such that a first filled ammunition canister 300 or 301 may be inserted in the device at the inboard position. After releasing handle 217, release peg 216 again protrudes into container element 200 insinuated beyond the distal end of inboard canister 300 or 301. The assistant gunner then places a second filled ammunition canister 300 or 301 into the device at the outboard position such that release peg 216 separates inboard canister 300 or 301 and outboard canister 300 or 301. The gunner then loads the ammunition belt from inboard ammunition canister 300 or 301 into the weapon and operates the weapon normally. When the first belt is exhausted and inboard canister 300 or 301 is empty, the gunner actuates top spring loaded catch 203 to swing hinged top access door 202 up and open and removes the inboard ammunition canister 300 or 301. After closing hinged top access door 202, the gunner actuates handle 217 retracting release peg 216 inside container element 200 such that the full ammunition canister 300 or 301 at the outboard position is freed to slide by means of gravity down nylon or Teflon wear strips 214 to the inboard position of containing element 200 adjacent to the weapon. The gunner loads the belt and operates the weapon normally. Subsequently, the assistant gunner actuates end spring loaded catch 207 to swing hinged end access door 206 away and open such that a single loaded canister 300 or 301 of ammunition may be inserted into the device such that it occupies the outboard position. By this means, the device may be kept continually full with loaded ammunition canisters 300 or 301. Both of these methods decrease the time to reload the weapon while improving firing rate and gunner safety. These processes are identical whether the device is configured to use with a M2A1 .50 caliber machine gun or whether adapter plate 220 has been installed and the device has been configured for use with a M240 7.62 mm machine gun.

In a first alternative embodiment, the mounting assembly is in the form of a right triangular prism, with a depth greater than the container element's width. Attached to this outward-facing, angled face of the mounting assembly are three mounting studs and two mounting bolts. The outward-facing, angled face of this mounting assembly is disposed at an angle greater than about 15° and less than about 35°—preferably about 25°—from the plane of the vertical end wall of the container element.

The first alternative embodiment of the device is used in the following manner: The gunner inserts the three mounting studs on the mounting assembly into three matching keyed mounting slots on the mating surface of a gun cradle. Simultaneously, both mounting bolts are allowed to protrude through mating slots in the gun cradle. Next, after the device has been mounted to the gun cradle two knurled mounting nuts are screwed onto the mounting bolts to secure the device to the gun cradle.

In a second alternative embodiment, the mounting assembly is in the form of a right triangular prism, with a depth greater than the container element's width. This mounting assembly is displaceably connected to the container element along the surface of the mounting assembly defined by the hypotenuse of the right triangular prism such that the line described by the most acute angle of the triangular prism is collinearly adjoined with the upper edge of the container element. In this embodiment, the container element may be located forward or backward in relation to the mounting assembly and fixed in place with respect to the mounting assembly by means of a fixing screw, such that the long side of the triangular prism opposite the side defined by the hypotenuse of the triangular prism faces out and is angled upward from the container element. Attached to this outward-facing, angled face of the mounting assembly are three mounting studs and two mounting bolts. The outward-facing, angled face of this mounting assembly is disposed at an angle greater than about 15° and less than about 35°—preferably about 25°—from the plane of the vertical end wall of the container element.

The second alternative embodiment of the device is used in the following manner: The gunner adjusts the position of the container element forward or backward in relation to the mounting assembly and fixes it in place by means of a fixing screw. The position chosen by the gunner is determined by the type of weapon the gunner is presently operating; with some weapons requiring that the container element be moved forward while others require that the container element be moved backwards with respect to the mounting assembly. The gunner inserts the three mounting studs on the mounting assembly into three matching keyed mounting slots on the mating surface of a gun cradle. Simultaneously, both mounting bolts are allowed to protrude through mating slots in the gun cradle. Next, after the device has been mounted to the gun cradle, two knurled mounting nuts are screwed onto the mounting bolts to secure the device to the gun cradle.

In a third alternative embodiment the mounting assembly is in the form of a right triangular prism wherein the long side of the triangular prism opposite the side defined by the hypotenuse is tapped along its top edge (at the vertex of the angle formed by the longer side and the side defined by the hypotenuse) with a multiplicity of screw holes. A length of 90-degree angle iron perforated along one side with a multiplicity of holes drilled in the same pattern as the multiplicity of tapped holes on the mounting assembly is provided. This 90-degree angle iron is attached to the mounting assembly at its top edge (the edge defined by vertex of the angle formed between the longer side and the side defined by the hypotenuse) by means of a multiplicity of screws. The 90-degree angle iron is installed such that the side opposite the perforated side of the 90-degree angle iron points down thus forming a channel between the un-perforated inner surface of the 90-degree angle iron and the outward-facing, angled face of the mounting assembly, the width of the channel being such that it is sufficient to fit over the horizontal, top edge of the mating surface of a gun cradle when the device is mounted to the gun cradle.

The third alternative embodiment is used in the following manner: The gunner attaches the outward-facing, angled face of the device to two (or three) of the mounting slots on the mating surface of a gun cradle while slipping the channel formed by the 90-degree angle iron over the horizontal, top edge of the mating surface of a gun cradle. Using the single (or double) mounting bolts and knurled nuts, the gunner secures the device to the gun cradle.

In a fourth alternative embodiment the aforementioned mounting assembly is in the form of a right triangular prism wherein the long side of the triangular prism opposite the side defined by the hypotenuse of the triangular prism extends beyond the vertex of the angle formed between the longer side and the side defined by the hypotenuse and is bent forward, away, and down from the longer side of the mounting assembly to form a channel, the width of which is sufficient to fit over the horizontal, top edge of the mating surface of a gun cradle when the device is mounted to the gun cradle.

The fourth alternative embodiment of the device is used in the following manner: The gunner attaches the outward-facing, angled face of the device to two (or three) of the mounting slots on the mating surface of a gun cradle while slipping the channel formed at the top of the outward-facing, angled face of the device over the horizontal, top edge of the mating surface of a gun cradle. Using the single (or double) mounting bolts and knurled nuts, the gunner secures the device to the gun cradle.

In all embodiment and variants, the aforementioned nylon wear strips may be replaced with Teflon wear strips installed in the bottom of the container element.

In all embodiment and variants, the aforementioned nylon or Teflon wear strips are replaced with metal rollers installed in, or on, the bottom of the container element.

While the invention has been described in connection with what are considered to be the most practical and preferred embodiments, it is to be understood that the invention is not to be limited to the disclosed embodiments, but on the contrary is intended to cover various modifications and equivalent arrangements included within the spirit and scope of the disclosure. More specifically: 1) Variants that seek to increase the number of ammunition canisters that may be loaded; and/or, 2) Variants that seek to change the overall shape of the device, from its present arrangement wherein the ammunition canisters are linearly aligned to non-linear arrangements; and/or, 3) Other variants adapted for use with other belt fed weapons such as grenade launchers, etc.; and/or, 4) Other variants adapted for use with other gun cradles with differing numbers of mounting slots and/or bolt slots are included within the spirit and scope of the present disclosure.

What is claimed is:

1. An appliance facilitating the rapid reloading of belt-fed machine guns, comprising:

a. a containing element in the form of an rectangular prism with an open top, a bottom panel, two long side walls, and two short end walls, said containing element capable of containing at least two ammunition canisters oriented end-to-end;

b. a mounting assembly with angled mounting face affixed to one of said short end walls of said containing element;

c. at least one spring actuated release peg penetrating into said containing element for separating said ammunition canisters so that they do not touch; and d. at least two wear strips removably attached to the inside surface of the bottom panel of said containing element such that said wear strips extend the full interior length of said containing element and are aligned parallel to the longitudinal axis of said containing element.

2. The appliance of claim 1 wherein said long side walls and said short end wall opposite said mounting assembly are flared out with respect to said containing element at their respective top edges.

3. The appliance of claim 1 wherein said mounting face presents two mounting studs and one mounting bolt.

4. The appliance of claim 1 wherein said mounting face presents three mounting studs and two mounting bolts.

5. The appliance of claim 1 wherein said open top is substantially covered by a hinged top access door wherein said hinged top access door is held in the closed position by a first spring loaded catch and said short end wall opposite said mounting assembly further comprises a hinged end access door wherein said hinged end access door is held in the closed position by a second spring loaded catch.

6. The appliance of claim 5 further comprising an adapter plate adapting said containing element such that it is capable of containing at least two ammunition canisters narrower than said containing element oriented end-to-end.

7. The appliance of claim 5 wherein said mounting face presents two mounting studs and one mounting bolt.

8. The appliance of claim 5 wherein said mounting face presents three mounting studs and two mounting bolts.

9. The appliance of claim 5 wherein said ammunition canisters may contain a belt of 7.62 mm machine gun ammunition.

10. The appliance of claim 1 wherein said ammunition canisters may contain a belt of .50 caliber machine gun ammunition.

11. The appliance of claim 1 wherein said ammunition canisters may contain a belt of 40 mm grenades.

* * * * *